United States Patent [19]

Byrns

[11] Patent Number: 4,671,424

[45] Date of Patent: Jun. 9, 1987

[54] INSULATED CAN HOLDER

[76] Inventor: James E. Byrns, 1027 2nd Ave. S., Clinton, Iowa 52732

[21] Appl. No.: 923,271

[22] Filed: Oct. 27, 1986

[51] Int. Cl.[4] ..... B65B 11/00

[52] U.S. Cl. ..... 220/408; 220/412; 220/85 H; 150/52 R; 215/12 A; 215/13 R

[58] Field of Search ..... 220/408, 410, 411, 412, 220/413, 85 H; 150/52 R; 215/12 A, 13 R, 100.5

[56] References Cited

U.S. PATENT DOCUMENTS 4,194,627 3/1980 Christensen ..... 220/412 X
4,293,015 10/1981 McGough ..... 220/412 X
4,462,444 7/1984 Larson ..... 215/12 A X
4,478,265 10/1984 DeMarco ..... 220/85 H X
4,534,391 8/1985 Ventimiglia et al. ..... 220/85 H X

*Primary Examiner*—Steven M. Pollard
*Attorney, Agent, or Firm*—Thomas J. Greer, Jr.

[57] ABSTRACT

An insulated can holder defined by an outer shell of a moldable, resilient plastic material and an inner, removable insulating liner inside of the outer shell. The shell carries at least one flat, indicia bearing and integral portion whose interior surface bears against the insulating liner to thereby define a nin-circular cross section of the holder and thereby increase the contact and friction between a can and the liner.

3 Claims, 4 Drawing Figures

INSULATED CAN HOLDER

BACKGROUND OF THE INVENTION

This invention relates to an insulated can holder of the type adapted to thermally insulate a can to thereby maintain it and its contents at a below ambient temperature. Such bottle insulators are placed around a cooled can after it has been taken from a refrigerator and while its contents, such as a carbonated beverage, are consumed.

SUMMARY OF THE INVENTION

According to the practice of this invention, a thermally insulated can holder is fashioned from a moldable plastic material, such as low density polyethylene, the holder being in the general form of an open ended cylinder which is closed at its bottom end. The holder contains a removable insulating liner, the latter being in the general form of a rectangular sheet of a closed cell polyethylene sheet bent end to end to a generally cylindrical form so as to conform to the generally circular inner sides of the holder. The holder is provided with a plurality of annular, spaced horizontally extending ridges, to thereby define valleys between them and enhance the ease with which the holder may be grasped by the fingers. Further, one or more flat portions are provided on the holder, extending generally vertically and interrupting the ridges, to thereby facilitate the display of indicia, such as advertising indicia, on the can holder. The interior surfaces of the flat, indicia bearing portions extend radially inwardly somewhat so as to give the insulating liner a slightly elliptical shape. The narrowmost portions of the insulating liner frictionally grip the can exterior to thereby define additional support for the bottle. The closed cell insulating liner may be removed for cleaning or for replacement.

DESCRIPTION OF THE INVENTION

Figure 1:
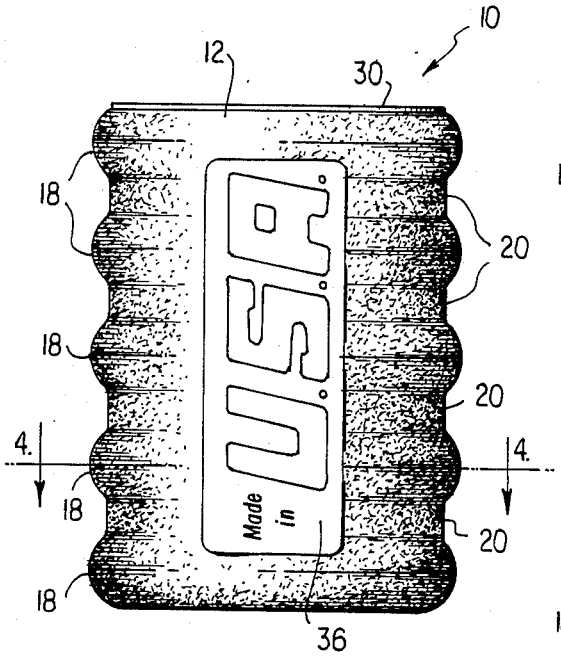
FIG. 1 is a side elevational view of the holder.

Referring now to the drawings, the numeral 10 denotes generally the insulated can holder of this invention and it includes a shell formed from a moldable, resilient thermoplastic material, such as low density polyethylene, and having a generally cylindrical shell 12.

The shell includes horizontal ridges each denoted by the numeral 18, the spaces between the ridges defining valleys denoted by the numeral 20. The valleys 20 facilitate engagement of the holder by the fingers of the user. The numeral 24 denotes the closed bottom of the shell, the bottom being slightly raised at its central portion relative to its radially outermost portion 26. The diameter of the top opening 28, which is adjacent uppermost rim 30, is slightly larger than the diameter of a can which is to be inserted into the holder, and is slightly smaller than the diameter of an insulating liner to be described. The numeral 34 denotes the interior surface of flat, vertically extending portions 36. There are two such elements 36, these being termed flats. They are formed integrally with shell 12 and are adapted to carry indicia on their external surfaces, as shown at FIG. 1.

The numeral 42 denotes an insulating liner, originally rectangular in shape, and fashioned from a sheet of closed cell polyethylene. The upper portion of liner 42 is adjacent rim 30, while its lower portion is supported by portion 26 of the closed bottom of the shell. Insulating liner 42 has an internal memory or bias and hence tends to remain flattened, in its original, planar configuration, so that when rolled to a cylindrical form and inserted into the shell, it exhibits a tendency to move radially outwardly and firmly abut against the interior surfaces 34 of the flats 36 and 40 of the valleys 20 of the cylindrical shell 12. The inner diameter of liner 42 is substantially the same size or slightly less than the external diameter of the can. The numeral 44 denotes the abutting ends of the liner.

Figure 3:
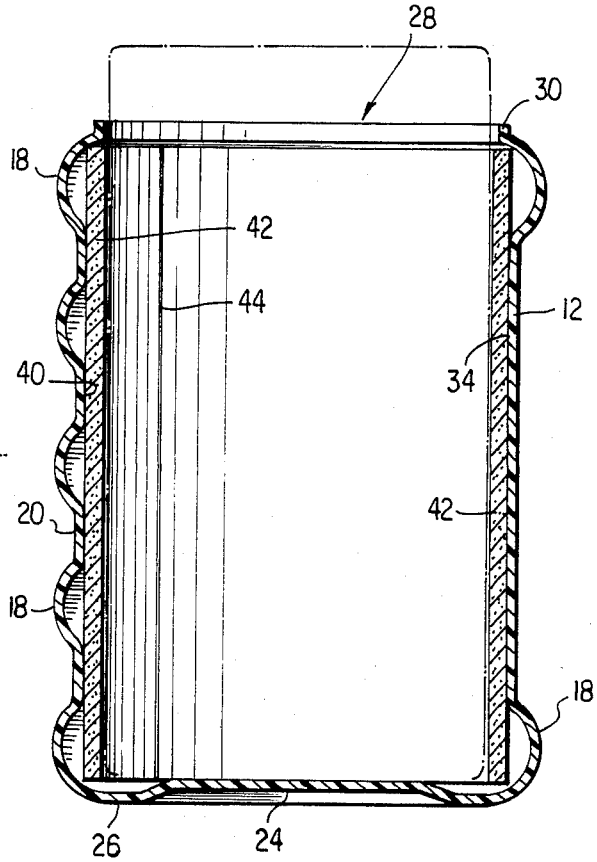
FIG. 3 is a sectional view taken along section 3—3 of FIG. 2.
Figure 2:
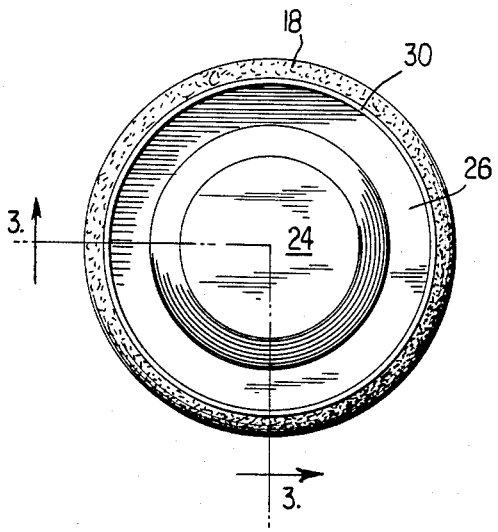
FIG. 2 is a top view of the holder.
Figure 4:
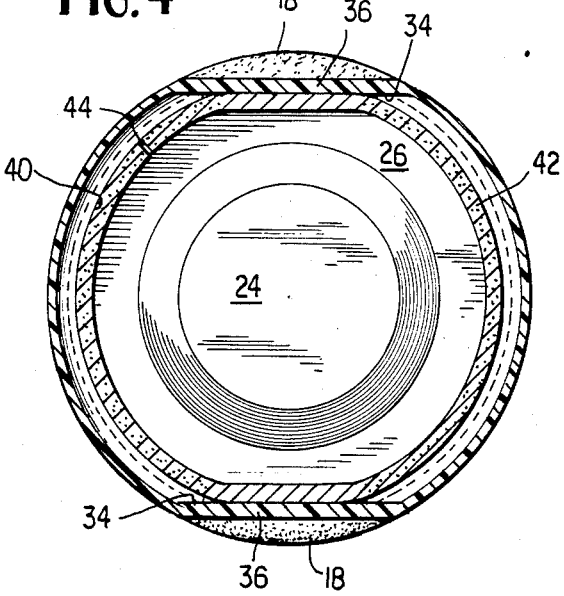
FIG. 4 is a sectional view taken along section 4—4 of FIG. 1.

The operation of the insulated can holder of this invention is as follows. With the insulating liner 42 having been inserted into the interior of the holder, a cooled can, indicated in dashed lines in FIG. 3, is inserted until it strikes the bottom 24. The interior surfaces 34 of indicia bearing flats 36 are slightly radially inwardly of the interior surfaces 40 of valley portions 20, to thereby impart a slightly elliptical or non circular shape to the liner 42, as shown at FIG. 4. This provides a degree of friction beetween the liner and the exterior surface of a can in the holder. Flat portions 36, in the manufacture of the holder, may be formed slightly towards or slightly away from the holder interior, to thereby slightly vary the degree of eccentricity of the elliptical cross sectional shape of liner 42 and thus more readily accomodate cans of specific manufacturers which may be of slightly different diameters. A horizontal wall portion defined by the top of uppermost ridge 18 (see FIG. 3) prevents the liner from being removed from the holder when a can is removed. The flats 36 thus perform the dual function of displaying indicia and imparting a non circular shape to the liner 42.

The exterior surface of the holder, being the surfaces of ridges 18 and valleys 20, is textured to give a rough surface and thereby facilitate holding with the hand. The rings 18 and valleys or depressions 20 additionally function to give a corrugated construction and thereby impart structural integrity. This corrugating effect permits the holder to accommodate some can size variations by slightly changing its length.

Both the shell and insulating liner are fashioned from F.D.A. approved materials, approved for food packaging. A child could chew on the shell or on the liner with no harmful effects. Further, the toughness of the material would make it very difficult to bite off a piece.

The terms upper, lower, longitudinal and transverse are used to facilitate the description of the invention and are not to be construed as limiting terms.

I claim:

1. A thermally insulated can holder adapted to hold a cooled can and maintain it at a temperature below ambient, the can holder including a one piece cylindrical shell formed from a moldable and resilient plastic material, the shell being open ended and closed at its bottom and a separate, thermally insulating liner of generally cylindrical shape being in surface contact with the holder inner wall, the sides of said shell being provided with spaced horizontal ridges to thereby define spaced valleys therebetween, the ridges extending at least partially around the circumference of the shell whereby the shell can vary slightly in length to thereby accommodate cans of slightly different length and whereby the valleys define recesses for the fingers of a user, at least one vertically extending, flat, indiciareceiving surface on the external sides of the shell and extending longitudinally of the shell and interrupting said ridges and valleys, the interior portion of said flat surface forming a portion of the interior wall of said shell and contacting said insulating liner to cause said liner to assume a non-circular cross sectional shape.

2. The can holder of claim 1 wherein the uppermost portion of said shell carries a horizontal wall portion which defines an abutment for the upper end of said insulating liner to thereby inhibit extreme upward movement and distortion of the liner during removal of a can from the can holder.

3. The can holder of claim 1 wherein said said thermally insulating liner is defined by a planar and rectangular sheet of closed cell polyethylene having an internal bias so as to tend to remain flat and which is bent into cylindrical form and inserted into said cylindrical shell.

* * * * *